US005192836A

United States Patent [19]

Schroder, deceased

[11] Patent Number: 5,192,836

[45] Date of Patent: Mar. 9, 1993

[54] APPARATUS FOR SELECTING AN ELEVATOR CAR FOR PHYSICALLY HANDICAPPED PERSONS FROM A GROUP OF ELEVATORS WITH IMMEDIATE ALLOCATION OF TARGET CALLS

[75] Inventor: Joris Schroder, deceased, late of Luzcerne, Switzerland, by Irmgard Schröder-Müller, heiress

[73] Assignee: Inventio AG, Hergiswil, Switzerland

[21] Appl. No.: 651,748

[22] Filed: Feb. 4, 1991

[30] Foreign Application Priority Data

Feb. 5, 1990 [CH] Switzerland ..... 00357/90

[51] Int. Cl.[5] ..... B66B 1/20

[52] U.S. Cl. ..... 187/126; 187/127; 187/131

[58] Field of Search ..... 187/126, 131, 11, 121

[56] References Cited

U.S. PATENT DOCUMENTS

| | | | |
|---|---|---|---|
| 4,026,389 | 5/1977 | Magee | 187/126 |
| 4,878,562 | 11/1989 | Schroder | 187/127 |
| 4,915,197 | 4/1990 | Schroder | 187/121 |
| 4,991,694 | 2/1991 | Friedli | 187/127 |

FOREIGN PATENT DOCUMENTS

| | | |
|---|---|---|
| 2037014 | 7/1980 | United Kingdom . |
| 2216683 | 10/1989 | United Kingdom . |

*Primary Examiner*—A. D. Pellinen

*Assistant Examiner*—Lawrence E. Colbert

*Attorney, Agent, or Firm*—William J. Clemens

[57] ABSTRACT

An elevator car suitable for use by physically handicapped passengers can be selected from a group of elevator cars under the control of a group control wherein call registering and indicating devices positioned at the floors served by the cars include an additional key for activating a switching circuit. The switching circuit is connected to a car load memory and a memory for storing the alighting calls for target floors where passengers are to leave the cars. A first condition is satisfied when there is no alighting call for a car, no exiting passenger to interfere with an entering wheelchair, and a second condition is satisfied when the load, number of passengers, in a car is smaller than a certain load limit value indicating sufficient space for the wheelchair. The switching circuit is also connected to a comparator which compares the travelling time required for a car to travel from its current position to the call entry floor with the traverse time needed by a physically handicapped person to traverse the path between the actuated call registering and indicating device and the shaft door of the elevator concerned. A third condition for the selection of a car is fulfilled when the travelling time is greater than the traverse time. When all three conditions are fulfilled for a car, that car is enabled to participate in the call allocation procedure to determine which car in the group will serve the call.

8 Claims, 4 Drawing Sheets

APPARATUS FOR SELECTING AN ELEVATOR CAR FOR PHYSICALLY HANDICAPPED PERSONS FROM A GROUP OF ELEVATORS WITH IMMEDIATE ALLOCATION OF TARGET CALLS

BACKGROUND OF THE INVENTION

The present invention relates generally to an apparatus for the selection of a elevator car for physically handicapped persons and, in particular, to such an apparatus operating in a group elevator control with the immediate allocation of target calls.

Known group elevator controls have call registering and indicating devices which are located on the floors to be served and include a keyboard for the input of calls for desired target floors. Such controls also have floor call memories which are associated with each elevator of the elevator group and are connected with the call registering and indicating devices, wherein a call identifying the input floor and a call identifying the target floor are stored in the call memories on the input of a call at a floor. A load memory, in which the number of the persons present in the respective elevator car is stored for each floor, and travelling time memories associated with the elevators of the group, are also provided for determining the desired allocation of the call.

A group control which is similar to the control described above is shown in the European Patent Specification No. EP-A 0 356 731 and uses the smallest waiting time of all passengers as the criterion for the allocation of the cars to the entered calls. In this control, the travel targets can be entered on the floors for example by call registering and indicating devices shown in the European Patent Specification No EP-A 0 320 583. Immediately after the registration and transmission of a call into a call memory organized according to entry and target floors, a computer in the form of a microprocessor computes a sum from data specific to the cars which sum is called the operating costs and corresponds to the waiting time which would arise for the passengers in the servicing of the call by each cars, The operating costs are transferred into a costs register immediately after the computation and subsequently compared at once by means of a comparison device with the operating costs of the other elevator cars. In this case, an allocation instruction is stored in an allocation memory of that elevator which displays the lowest operating costs. Immediately after the allocation of the car to the call has taken place in this manner, the elevator concerned and its position is indicated in an indicating field of the actuated call registering and indicating device so that the passenger can move in time to the associated shaft door.

Optimum results in respect of the smallest waiting times of the passengers can be achieved by the aforedescribed group control. For certain users of the elevators, such as for example use by physically handicapped persons, this control is however not readily suitable since other criteria must be the basis for the selection of an elevator car in this case.

The present invention is therefore based on the task of modifying the type of group elevator control described above in such a manner that physically handicapped persons have sufficient time to reach the shaft door of the selected elevator before arrival of the car at the floor, that they can board unhindered and that, in particular, wheelchair users have sufficient space in the car.

SUMMARY OF THE INVENTION

The present invention concerns an apparatus for operating a group elevator control A switching circuit is connected to receive data from a car load memory and a second memory portion for the calls for the target floors of the floor call memory Such a circuit is provided for each elevator for each floor and in the absence of an alighting call and in the case of a load which is smaller than a certain load limit value, a first and a second condition for the selection of a car are fulfilled. An alighting call is a call registered by a passenger who wishes to leave the car at the target floor he has selected. The load limit value is the car load, number of persons in the car, below which it is assumed that there is sufficient room in the car to receive a wheelchair. The switching circuit is also connected to receive an output from a comparator which compares the travelling time of the car to the call entry floor with the time needed by a physically handicapped person to travel the path between the actuated call registering and indicating device and the shaft door of the elevator concerned, wherein a third condition for the selection of a car is fulfilled in the case where the travelling time is longer. The travelling time is the time required for a car to travel from its current position to the floor where the handicapped person has entered a call. An output of the switching circuit is connected with comparison equipment in such a manner that the elevator concerned can participate in the call allocation procedure when the first, second and third conditions are fulfilled.

The keyboards of the call registering and indicating devices include a key which is provided with a wheelchair symbol and by means of which the switching circuits of a floor are activated and the normal mode of operation is switched off. The advantages achieved by this invention are that the use of the elevators by physically handicapped persons becomes simpler with less problems since a car is selected each time from which nobody alights and which has sufficient space to conveniently receive a wheelchair. No abnormally long waiting time arises for the passengers in the car at the stop, because the path to be traversed by the physically handicapped person between the actuated keyboard and the indicated elevator was taken into consideration in the selection of the car in such a manner that the handicapped passenger already is positioned in front of the associated shaft door when the car arrives at the floor.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
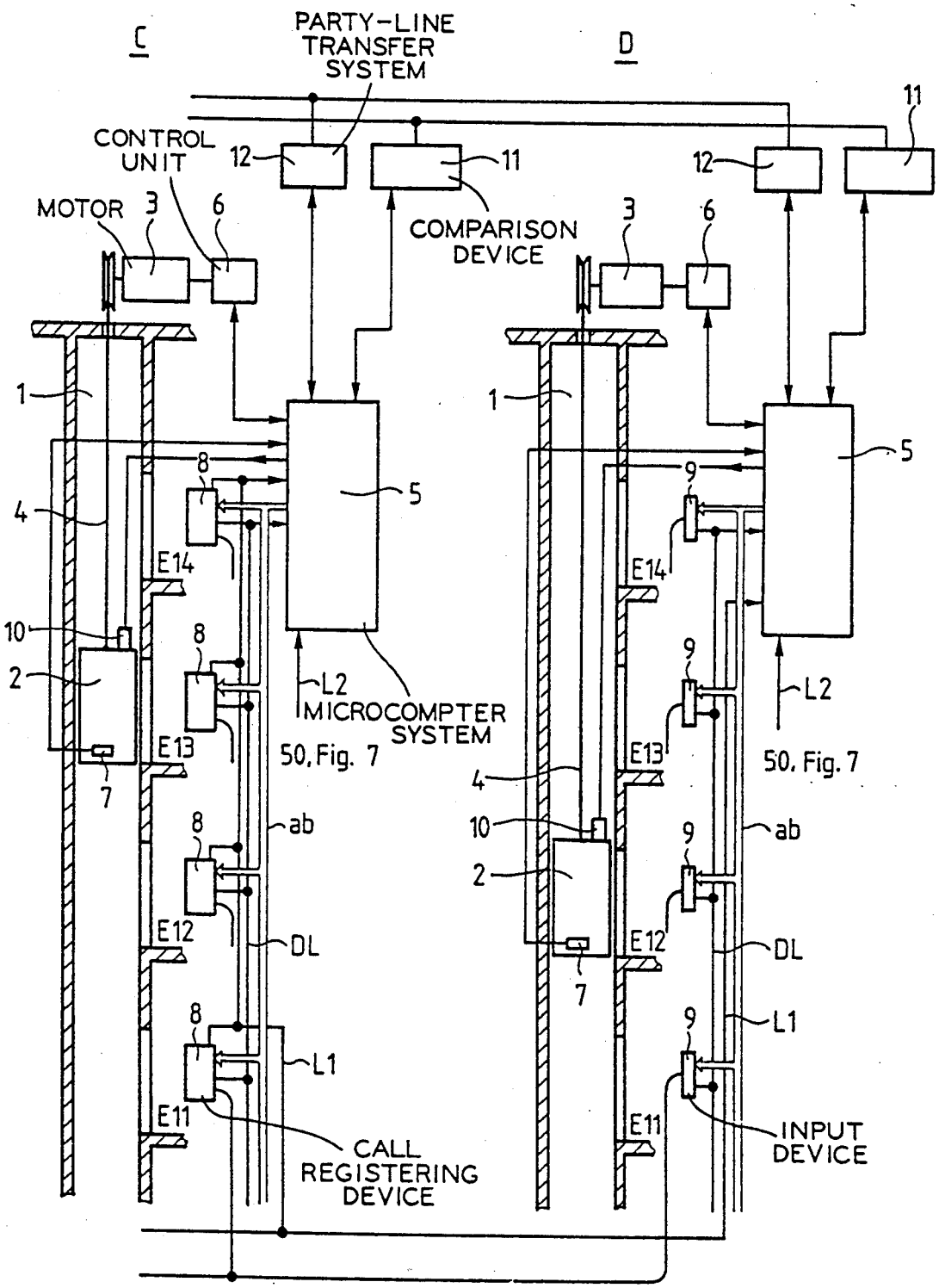
FIG. 1 is a schematic block diagram of a group control for two elevators of an elevator group according to the present invention.

In the FIG. 1 two elevators of a elevator group are denoted by C and D. Each elevator includes a car 2 guided in an elevator shaft 1 and driven by a hoist motor 3 through a hoisting cable 4 wherein fifteen floors E0 through E14, of a building are served. The hoist motor 3 is controlled by a drive control such as that shown in the European Patent No EP-B 0 026 406, wherein the target value generation the regulating functions and the stop initiation are realized by means of a microcomputer system 5. The system 5 is connected with a control unit 6 of the drive control. The microcomputer system 5 computes a sum known as the operating costs, which sum corresponds to the waiting time of all passengers and forms the basis of the call allocation procedure. The operating costs sum is computed from data specific to the elevator as is shown in the European Patent Specification No EP-A 0 356 731.

Each car 2 includes a load measuring device 7, which is likewise connected with the associated microcomputer system 5. Call registering and indicating devices 8, which are shown in the European Patent Specification No. EP-A 0 320 583, are provided at the floors and have decade keyboards by means of which calls for travels to desired target floors can be entered The call registering and indicating devices 8 are connected by an address bus ab and a data input conductor DL with the microcomputer system 5. The call registering and indicating devices 8 on each floor are connected to one another and can be associated with more than one elevator of the group, wherein, for example, those devices of the elevator C are connected by way of multiplexers 9 to the microcomputer system 5 of the elevator D.

Each car 2 has a door drive 10 connected with the associated microcomputer system 5 for controlling the opening and closing of the car and shaft doors as well as control of the time for which these doors are kept open. The microcomputer systems 5 of the individual elevators of the group are connected to one another by a comparison device 11 shown in the European Patent No. EP-B 0 050 304 and a party line transfer system 12 shown in the European Patent No EP. B-0 050 305. The microcomputers 5 and the call registering and indicating devices 8 form a group control similar to the control shown in the aforementioned Specification No. EP-A 0 356 731.

The call registering and indicating devices 8 are furthermore connected by way of a first conductor L1 and a second conductor L2 to the microcomputer systems 5. As described more fully below by reference to the FIGS. 3 and 4, an information signal can be transmitted by way of the conductor L1 to the microcomputer systems 5, by which information signal the group control can be switched over to a mode of operation suitable for physically handicapped passengers. A signal by means of which the microcomputer systems 5 can identify an actuated call registering and indicating device 8, can be transmitted by way of the second conductor L2 as described below with the aid of the FIG. 7.

Figure 2:
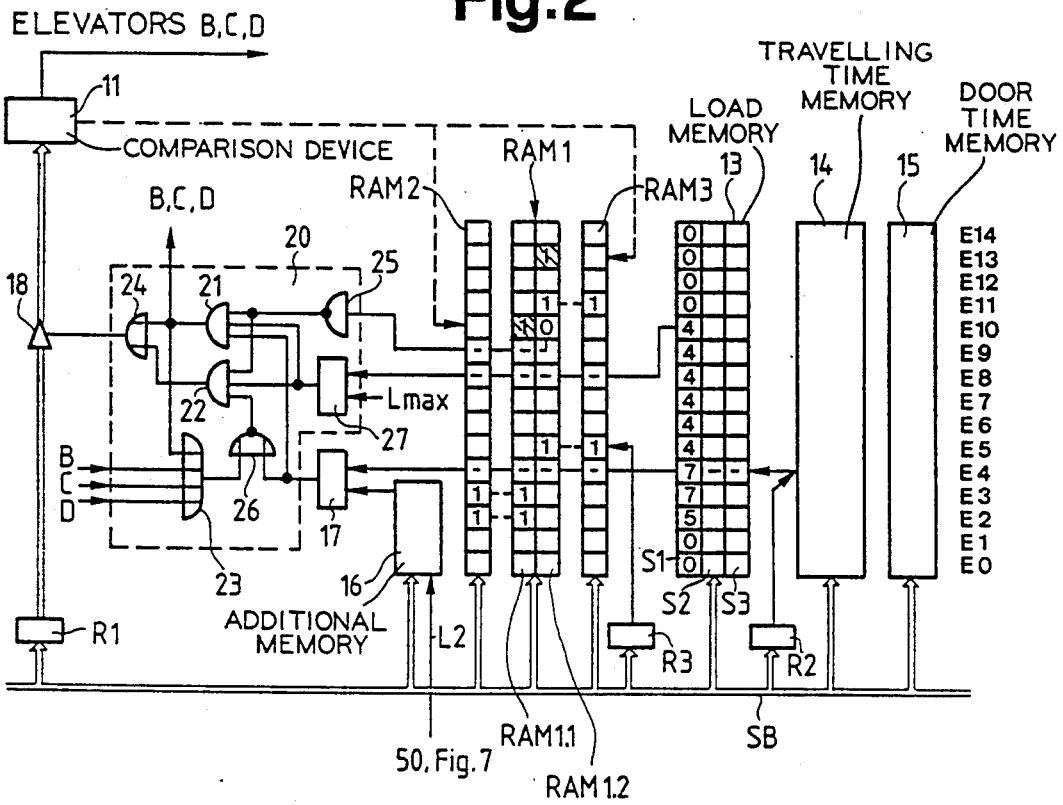
FIG. 2 is a schematic block diagram of a portion of the group control according to FIG. 1 showing a switching circuit according to the present invention associated with one car.

That part of the microcomputer system 5 which is illustrated schematically in the FIG. 2 and associated, for example, with the elevator A, includes a floor call memory RAM1 and first and second call allocation memories RAM2 and RAM3, which for each direction of travel possess storage spaces corresponding to the number of the floors, wherein merely the spaces associated with the upwards calls are illustrated. The floor call memory RAM1 consists of first and second memory portions RAM1.1 and RAM1.2, wherein the calls designating the respective entry floors are stored in the first memory portion RAM1.1 and the calls identifying the target floors are stored in the second memory portion RAM1.2, and wherein the first call allocation memory RAM2 is associated with the first memory portion RAM1.1 and the second call allocation memory RAM3 is associated with the second memory portion RAM1.2.

An operating costs register for storing the operating costs is denoted by R1 and a car position register is denoted by R2. A selector R3, in the form of a further register, generates addresses which correspond to the floor numbers and by means of which the storage places of the memories RAM1.1, RAM1.2, RAM2 and RAM3 can be addressed. While the selector R3 always indicates that floor at which the travelling car 2 could still stop, the car position register R2 always indicates that floor in the region of which the car 2 is actually situated. The floor call memory RAM1 as well as the first and the second call allocation memories RAM2 and RAM3 are read-write memories which are connected with a bus SB of the microcomputer system 5. A load memory, which is likewise connected with the bus SB and described in more detail below is denoted by 13.

As shown in the FIG. 2, the calls stored in the floor call memory RAM1 and the allocation instructions stored in the call allocation memories RAM2 and RAM3 are identified symbolically by "1", wherein allocated calls (dashed connecting line) are indicated in the case of the floors E2, E3, E5 and E11 and new, not yet allocated calls (hatched fields) are indicated in the case of the floors E10 and E13. A travelling time memory is denoted by 14 and a door time memory is denoted by 15, which memories are likewise connected with the bus SB. The memories 14 and 15, which are shown in the patent specification EP-A 0 356 731 cited above, are read-write memories in which data for the operating costs computation are stored. In this case, the travelling times of the car concerned between a floor and each other floor are stored in the travelling time memory 14, while the door opening and closing times of the elevator concerned are stored for each floor in the door time memory 15. The times which are needed by a physically handicapped passenger at a floor, for travel along the paths between the respectively actuated call registering and indicating devices 8 and the shaft doors of the elevator, are stored in an additional memory 16 connected to the bus SB.

A first comparator 17, which is for example formed by the processor of the microcomputer system 5, is connected at separate inputs with an output of the travelling time memory 14 and an output of the additional memory 16. The operating costs register R1 is connected with the comparison device 11 through a switching device 18 in the form of a tri-state buffer. Each floor is allocated a switching circuit 20 which is described below and which, upon the selection of the mode of operation for physically handicapped passengers, is connected at inputs with the storage cells of the second memory portion RAM1.2, the load memory 13 associated with the respective floor and the output of the first comparator 17. At an output, the switching circuit 20 is connected to the activating lead of the tri-state buffer of the switching device 18.

The load memory 13, which is shown in the European Patent Application No. EP-PA 88106273, includes a read-write memory in the form a matrix which has as many rows as there are floors and three columns S1, S2 and S3. The first column S1 of the matrix is allocated to the calls of the same direction of travel as and lying in front of the car 2, the second column S2 is allocated to the calls of the opposite direction of travel and the third column S3 is allocated to the calls of the same direction of travel as and lying behind the car 2. In the storage places of the load memory 13, load values are stored in the form of a number of persons who are situated in the car 2 on the departure from or the travel past a floor.

As an example, it is assumed that in the FIG. 2 the car 2 is in upward travel in the region of the floor E4 and that upward calls were entered at the floors E2, E3 and E10. After the transfer of the calls into the first and second memory portions RAM1.1 and RAM1.2, a sum is formed from the number of the calls (boarding passengers) entered at a floor and the number of calls (alighting passengers) designating this floor as a travel target and that sum is stored as a load value in the load memory 13. The first column S1 of the load memory 13 will therefore, by reason of the chosen number of boarding and alighting passengers display the load values evident from the FIG. 2. Thus, the load value "4" for the floor E10 results from five boarding passengers at the floor E2, two boarding passengers at the floor E3 and three alighting passengers at the floor E5. During the computation of the operating costs, the computer can call up from the load memory 13 the number of the passengers which are situated in the car 2 at a future stop. Thus, it can be ascertained by reference to the stored values whether an overload would arise on allocation of a certain floor to a certain car 2.

As described in the preceding, conclusions are drawn in the setting up of the load memory 13 from the entered calls concerning the future boarding and alighting passengers and the loads in the car 2 arising thereby It would, however, be possible that passengers enter their call more than once or that passengers board who have not entered any call. In these cases, the stored load values must be corrected. For this purpose, the load memory 13 is connected (FIG. 1) by way of the microcomputer system 5 with the load measuring device 7 of the car 2. In the first case, as many of the same target calls are deleted at the floor concerned as correspond to the difference between the stored load value and the actually measured car load. Thereafter, all stored load values between the boarding floor and the target floor of the call entered more than once are corrected. In the second case, the stored load values must be increased, for which it is presumed that the passenger who has entered no call wants to travel to a target floor which is identified by a call already entered by another passenger. If several calls were entered, it is assumed that the passenger in question wants to travel to the furthest target.

The switching circuit 20 includes first and second AND gates 21 and 22, first and second OR gates 23 and 24, a NOT gate 25, a NOR gate 26 and a second comparator 27. A first input of the first AND gate 21 is connected through the NOT gate 25 with that storage cell of the second memory portion RAM1.2 which is associated with the floor concerned. A second input of the first AND gate 21 is connected to an output of the second comparator 27 having an input connected with the related storage cell of the load memory 13. The second comparator 27 has another input of which a load limit value "$L_{max}$" is applied. A third input of the first AND gate 21 is connected to an output of the first comparator 17. A first input of the second AND gate 22 is connected with the first input of the first AND gate 21 and a second input is connected with the output of the second comparator 27. A third input of the second AND gate 22 is connected with an output of the NOR gate 26, a first input of which is connected to the output of the first comparator 17. A second input of the NOR gate 26 is connected with an output of the first OR gate 23, a first input of which is connected to the output of the first AND gate 21 and a second a third and a fourth input of which are connected with outputs of first AND gates 21 (not shown) of the switching circuits associated with the elevators B, C and D.

An output of the first AND gate 21 is connected with a first input of the second OR gate 24, a second input of which is connected to an output of the second AND gate 22 and an output of which is connected with the activating connection of the tri-state buffer 18. The switching circuit 20, which is for example formed as a program in the microcomputer system 5 is activated each time for the call entry floor concerned upon the switching to the mode of operation suitable for physically handicapped passengers.

Figure 3:
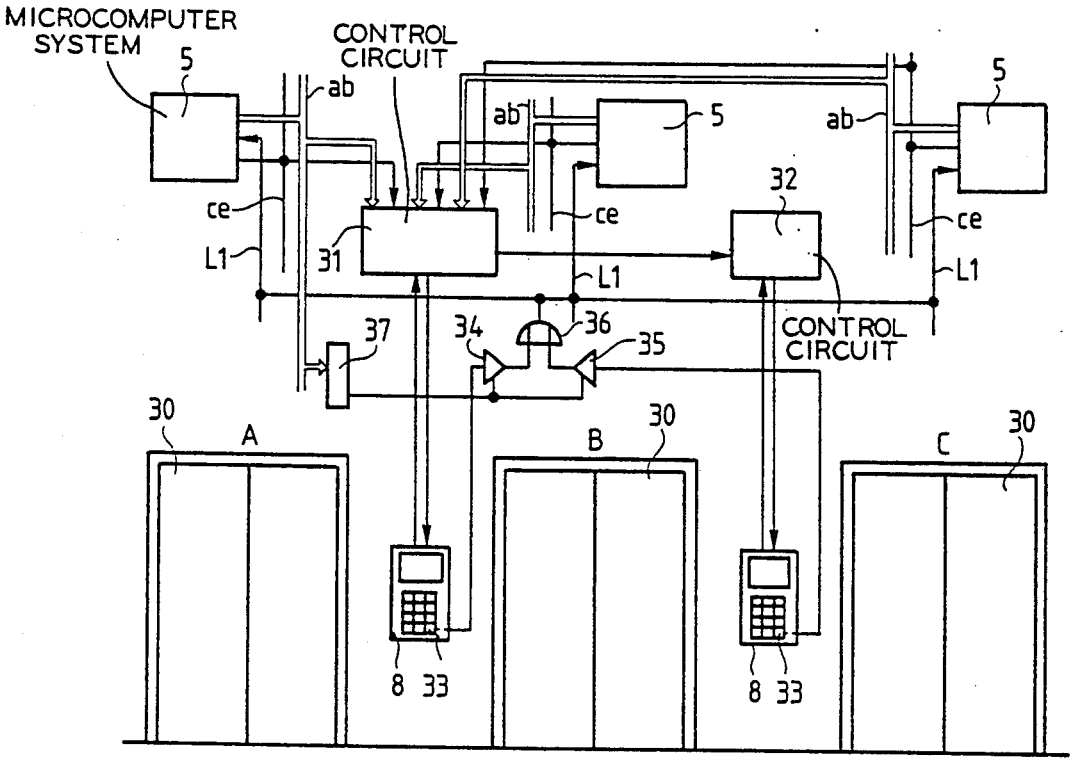
FIG. 3 is a schematic block diagram of the call registering and indicating devices positioned at a floor for three elevators of the elevator group of FIG. 1.

In the FIG. 3, a floor is shown with the shaft doors of the elevators A, B and C of the elevator group denoted by 30. Between the shaft doors, call registering and indicating devices 8 are provided, which devices as described in detail in the specification EP-A 0 320 583, are for the indication of the selected car and position of the elevator concerned. The devices 8 are connected by way of control circuits 31 and 32, the address buses ab and block release lines ce with the microcomputer systems 5 respectively associated with the elevators. The call registering and indicating devices 8 each include an additional key or pushbutton 33 shown in larger scale in FIG. 4. The outputs which are associated with the additional keys 33 of the call registering and indicating devices 8 are connected by way of tri-state buffers 34 and 35 with a respective input of an OR gate 36, the output of which is connected to the first conductor L1. The activating leads of the tri state buffers 34 and 35 are connected to the respective output associated with a certain floor, of a decoder 37 which has an input connected with the address bus ab for example, of the elevator A.

Figure 4:
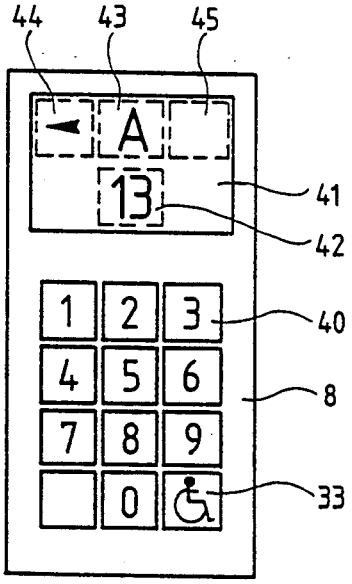
FIG. 4 is an enlarged front elevational view of one of the call registering and indicating devices shown in FIG. 3 with a key for the initiation of a travel by a physically handicapped person.

According to the FIG. 4, the call registering and indicating device 8, as shown in the specification EP.A 0 320 583 has a keyboard 40 for the input of calls for desired target floors and has an indicating field or display 41 in which four indicating elements 42 43, 44 and 45 are arranged. In this case, the first indicating element 42 indicates the number of the respectively entered target floor, the second indicating element 43 indicates the selected elevator in the form of a letter, and the third and fourth indicating elements 44 and 45 each in the shape of an arrow, indicate the position of the shaft doors for the selected elevator in relation to the actuated keyboard. The additional key 33 which is provided for the switching over to the mode of operation suitable for physically handicapped passengers, is provided with a wheelchair symbol which is capable of being felt in order that visually handicapped persons also can find this key and actuate it. The key 33 is connected, as is known from the EP-A 0 320 583 printed specification but not shown here with a storage element having an output connected with the first conductor L1 as indicated in the description of the FIG. 3.

Figure 5:
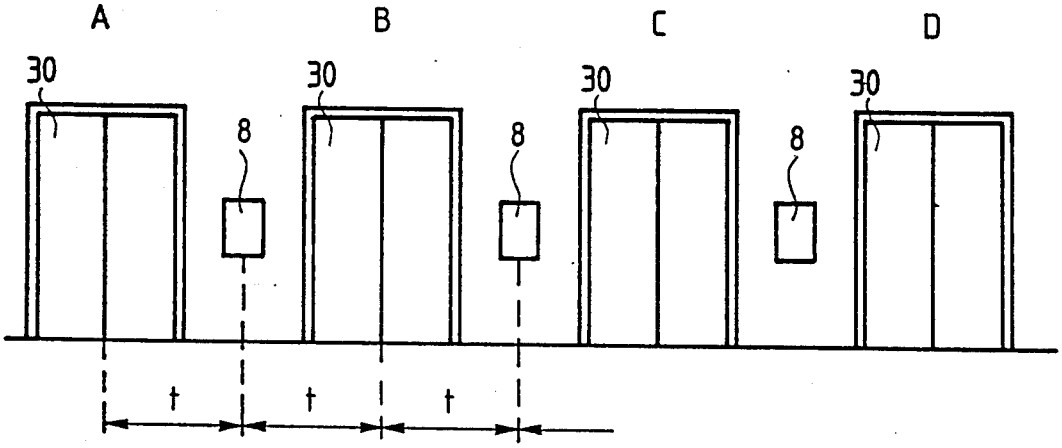
FIG. 5 is an elevational view of the call registering and indicating devices positioned at a floor for an elevator group consisting of four elevators according to the present invention.

According to the FIG. 5, the shaft doors 30 of the elevators A, B, C and D of the elevator group can be equally spaced along a wall while the call registering and indicating devices 8 are located between adjacent pairs of the shaft doors 30. Denoted by "t" is an empirically derived time which a physically handicapped passenger needs for traversing the path between the call registering and indicating device 8 actuated by him and the respectively adjacent shaft door 30. In the case of the arrangement shown, a physically handicapped person would therefore, on actuation of the call registering and indicating device 8 between the elevators A and B and allocation of the elevator D, need a time of "5t" to get to the shaft door 30 associated with the elevator D.

Figure 6:
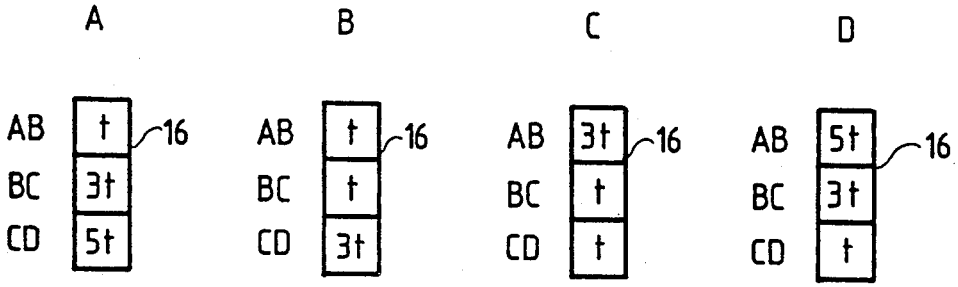
FIG. 6 is a schematic illustration of memories associated with the elevators of FIG. 5 for storing the times which a physically handicapped passenger needs to travel the paths between the various combinations of the call registering and indicating devices and the shaft doors.

The additional memories 16 (FIG. 2), which are associated with the elevators A, B, C and D, are shown in the FIG. 6 to include a number of storage places corresponding to the number of call registering and indicating devices 8 provided at a floor. In accordance with the physical arrangement illustrated in the FIG. 5, the additional memories 16 each have three storage places which are denoted in the sequence of the elevators by AB, BC and CD. The stored times shown in the FIG. 6 result from the definition of the time "t" indicated in the description concerning FIG. 5, wherein the time "5t", mentioned for example, is to be found in the storage place AB of the additional memory 16 associated with the elevator D.

Figure 7:
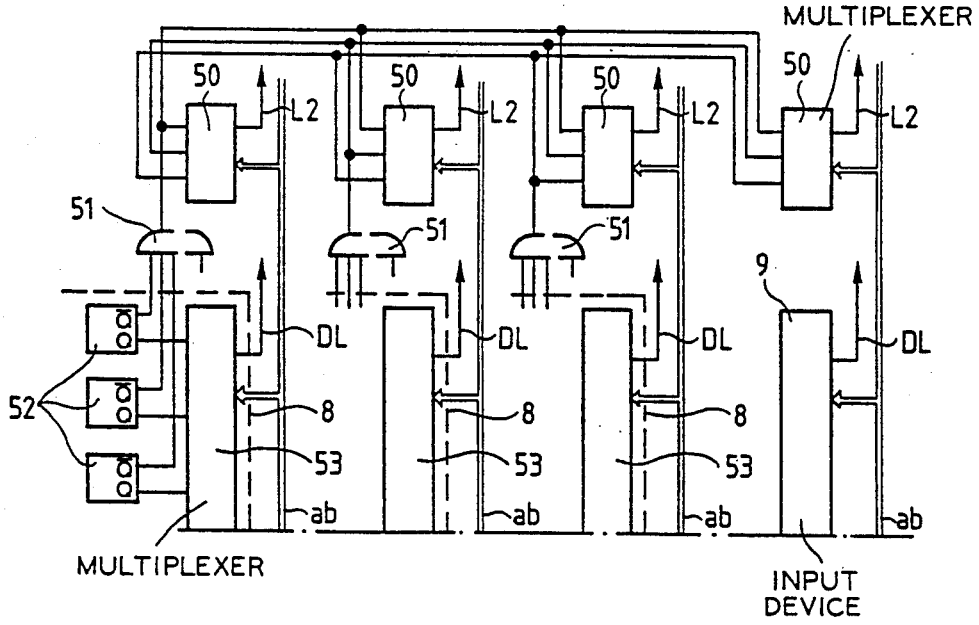
FIG. 7 is a schematic block diagram of a circuit connected to the memories of FIG. 6 for ascertaining which of the call registering and indicating devices is actuated on a floor.

Denoted by 50 in the FIG. 7 are multiplexers which are associated with the elevators and the call registering and indicating devices 8 of a floor and which each include a number of inputs corresponding to the number of the call registering and indicating devices 8 at that floor. The inputs of all of the multiplexers 50 which are associated with the call registering and indicating devices 8 for that floor are connected together. One input of each of the multiplexers 50 is connected to an output of an associated 25 AND gate 51 the inputs of which are connected to inverting outputs $\overline{Q}$ of storage cells 52 of the associated call registering and indicating device 8. The multiplexers 50 are connected to the address buses ab of the associated microcomputer systems 5 and each has an output connected (FIG. 2) through the associated second conductor L2 with the additional memory 16 of the associated microcomputer system. The noninverting outputs Q of the storage cells 52, as shown in the previously mentioned patent specification EP-A 0 320 583 or European Patent No. EP-B 0 246 395, are connected to address inputs of multiplexers 53 of the respective call registering and indicating devices 8 for interrogation of the calls entered at a floor.

The abovedescribed equipment operates as follows: Let it be assumed that a passenger using a wheelchair is situated on the floor 10 between the shaft doors of the elevators B and C shown in the FIG. 3 and, after the selection of the mode of operation by depressing the key 33, enters a call for the floor E13. During the scanning of the call registering and indicating devices 8 for newly entered calls, the storage element connected with the key 33 is interrogated first. In this case, the tri-state buffer 35 is activated by means of the decoder 37 upon the generation of the address for the floor E10 so that the stored information is transferred by way of the OR gate 36 and the first conductors L1 into the microcomputer systems 5 of all elevators (FIG. 3) and interpreted by the microprocessors in the sense that the following call must be processed by the mode of operation suitable for physically handicapped passengers. After the transmission of the call, a call identifying the input floor E10 is entered into the first memory portion RAM1.1 and a call identifying the target floor E13 is entered into the second memory portion RAM1 2 of the floor call memories RAM1 of all of the elevators (FIG. 2). Thereafter, the multiplexers 50 are interrogated (FIG. 7).

Upon actuation of the call registering and indicating device 8 located between the elevators B and C, the output of the associated AND gate 51 and thereby also the associated inputs of all of the multiplexers 50 become logic "0". Upon the appearance of the address associated with the respective input, the microprocessors of the microcomputer systems 5 interpret the signal "0", which is carried by the second conductor L2, in the sense that the content of the storage place BC of the additional memory 16 must be applied to the one input of the first comparator 17. Thereafter, the associated travelling time is read from the travelling time memory 14, in dependence on the car position contained in the car position register R2 and the address of the call input floor EIO, and is applied to the other input of the first comparator 17 (FIG. 2).

For this example, it is assumed that the travelling time of the elevator A is greater than the time "3t" stored in the storage place BC of the additional memory 16 (FIG. 6) and the output of the first comparator 17 is in this case logic "1". It is furthermore assumed that no call is stored for the floor E10 in the second memory portion RAM1.2 of the elevator A so that no alighting passengers are to be expected whereby a first condition for the car selection is fulfilled and a logic "1" appears at the first input of the first AND gate 21 (FIG. 2). The elevator cars can be of a size that a wheelchair would have sufficient space for a load limit value "$L_{max}$" of less than five persons. When the actual load falls below the load limit value, the output of the second comparator 27 can be a logic "1" so that, according to the example, a load value corresponding to four persons is stored in the load memory 13 of the elevator A, a second condition for the selection is fulfilled and a logic "1" appears at the second input of the first AND gate 21. With a logic "1" at the output of the first comparator 17 and therefore also at the third input of the first AND gate 21, a third condition for the car selection is fulfilled, for which the switching device 18 is switched by way of the second OR gate 24 into a conductive state so that the elevator A can participate in the call allocation procedure.

After the load value in the load memories 13 has been corrected in accordance with the newly entered call on the floor E10, the operating costs for the entry and target floors are computed for all elevators. An operating costs formula is used that is disclosed in the above, identified patent specification EP-A 0 357 731. As mentioned above the computer in this case reads the number of persons situated in the car from the load memory 13, the travelling times of the car from the instantaneous position to the entry or target floor from the travelling time memory 14, and the door opening and closing times from the door time memory 15. Immediately after the computation, the operating costs are transferred into the operating costs register R1 and compared with the operating costs of the other elevators by means of the comparison device 11 as shown, for example, in the patent EP-B 0 050 304.

Those elevators for which at least one condition for the car selection is not fulfilled are excluded from the comparison and the call allocation, since the switching device 18 in this case can not be switched into the conductive state. Let it now be assumed that the elevator A has the lowest operating costs so that an allocation instruction is entered (dashed arrows, FIG. 2) in the first call allocation memory RAM2 at the floor E10 and in the second call allocation memory RAM3 at the floor E13. Immediately after the allocation the selected elevator A and its position are indicated in the indicating field 41 of the call registering and indicating device 8 actuated by the wheelchair user (FIG. 4), whereupon the user moves to the correspondingly identified shaft door and arrives there before the selected car arrives After the termination of the selection procedure, the control continues to operate in the normal mode of operation, but no additional calls are allocated to the selected car until it has reached the call entry floor E10.

When, for example, the third condition is not fulfilled for any of the elevators A, B, C and D and the first and the second conditions are fulfilled merely for the elevator A, the output of the first comparator 17 and the output of the first OR gate 23 become logic "0" (FIG. 2). Thereby, a logic "1" appears at the output of the NOR gate 26 and at the third input of the second AND gate 22 so that the switching device 18 is switched into the conductive state by way of the second OR gate 24. At the same time, the state "1" present at the output of the NOR gate 26 is interpreted by the microprocessor so that the time for keeping the door of the selected car open is prolonged by a predetermined amount upon the arrival at the floor E10 by issuance of control signals for the door drive 11 (FIG. 1) so that a handicapped passenger can board. In this case, a door closing button located in the car can be made ineffective for the duration of the predetermined time for keeping the door open so that premature closure by passengers situated in the car and thereby premature departure of the car is prevented.

Acoustic signalling can be provided for visually handicapped persons. Thus it is possible that after the actuation of the key 33 and entry of the call for a desired floor, a first acoustic signal confirming the selection of a car is generated by the call registering and indicating device 8. Also, a second acoustic signal can be sounded, for example, after 0.5 seconds and before the arrival of the selected car at the shaft door of the elevator concerned so that a visually handicapped person is led along the correct path to the boarding position. Furthermore it is possible that a third acoustic signal can be produced during the travel of the selected car between the call entry and the target floors each time a floor is passed so that visually handicapped passengers can count to ascertain the arrival of the car at the target floor. The generation of the third acoustic signal can be terminated when the visually handicapped person has reached the target floor.

If the key 33 is not actuated the control operates in the normal mode of operation. In this case, the output of the first comparator 17 is connected directly with the switching device 18 (FIG. 2). The additional memory 16, which is connected with the one input of the first comparator 17, can in this case include additional storage places in which times that are reasonable for physically not handicapped passengers are stored for the paths between the respective actuated call registering and indicating devices 8 and the shaft doors of the elevators.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for the selection of a elevator car for use by physically handicapped persons from a group of elevators, the elevators of the group having immediate allocation of target calls, including call registering and indicating devices which are located on the floors served by the elevators and including a keyboard for the input of calls for desired target floors, call memories which are associated with each elevator of the group and connected with the call registering and indicating devices wherein a call identifying the input floor and a call identifying the target floor are stored in the call memories on the input of a call on a floor, load memories for storing a number of the persons present in the respective elevator car for each floor, travelling time memories for storing travel times between floors, computers associated with each of the elevators of the group and connected to the call memory, to the load memory, and to the travelling time memory for the respective elevator a comparison device connected to the computers, wherein each computer computes operating costs corresponding to the waiting times of passengers from data specific to the elevator, and an operating costs register connected with the computer and the comparison device and with allocation memories associated with the call memory wherein the operating costs for the elevators are compared one with the other by the comparison device and the call concerned is allocated to that elevator which has the smallest operating costs through entry of an allocation instruction into the allocation memories and wherein the elevator concerned and its position are indicated immediately after the call allocation on an indicating field of the actuated call registering and indicating device comprising:

a switching circuit for each elevator car of an elevator group at each floor served by the elevator car and connected at inputs with a load memory and a second memory portion of a call memory which stores alighting calls for target floors;

a first comparator having an output connected to an input of said switching circuit, said first comparator having inputs connected to an output of a travelling time memory and an output of an additional memory, wherein the times needed by physically handicapped persons for travelling the paths between the respectively actuated call registering and indicating device and the shaft doors of the elevators are stored in said additional memory;

said switching circuit being connected at an output with a switching device connected between an operating costs register and a comparison device wherein, in the absence of an alighting call in the second memory portion and for a load which is smaller than a load limit value as well as for a travelling time of the elevator car which is greater than the time needed by a physically handicapped person to travel from the call registering and indicating device to the shaft door of the elevator concerned, the switching device is actuated by said switching circuit and the elevator can participate in the comparison; and an additional key provided on the keyboards of the call registering and indicating devices for activating said switching circuits of an associated floor.

2. The apparatus according to claim 1 wherein the elevator car is accessible by way of doors which are actuated automatically by a door drive when stopping at a floor and said switching circuit is connected at an output with the door drive wherein, in the absence of an alighting call in the second memory portion and for a load which is smaller than a load limit value as well as for a travelling time of the elevator car which is less than the time needed by a physically handicapped person to move to the shaft door of the elevator concerned, the switching device is actuated so that the elevator can participate in the comparison and the time for which the door of the selected car is kept open is prolonged.

3. The apparatus according to claim 2 wherein the call memory, the load memory and the travelling time memory are formed by microcomputer systems associated with the elevators and said additional memory and said first comparator are formed by said microcomputer systems, outputs of the call registering and indicating devices which are associated with said additional keys are connected by way of tri-state buffers and an OR gate to first conductors which are connected with said microcomputer systems, activating leads of said tri state buffers are connected to a respective output, associated with a certain floor, of a decoder, an input of said decoder being connected with an address bus of said microcomputer system wherein, on actuation of said additional key at a floor and a generation of the corresponding address the information entered by the microcomputer systems by way of the first conductors has the effect that said switching circuits which are associated with the floor concerned are activated.

4. The apparatus according to claim 3 wherein said switching circuit includes a first and a second AND gate, a first and a second OR gate, a NOT gate, a NOR gate and a second comparator, a first input of said first AND gate being connected through said NOT gate with a storage cell of said second memory portion of said call memory which is associated with the floor concerned, a second input of said first AND gate being connected to an output of said second comparator, one input of said second comparator being connected with an associated storage cell of the load memory and another input of said second comparator having a load limit value applied, a third input of said first AND gate being connected to an output of said first comparator, a first input of said second AND gate being connected with a first input of said first AND gate and a second input of said second AND gate being connected with said output of said second comparator a third input of said second AND gate being connected with said output of said NOR gate, a first input of said NOR gate being connected to said output of said first comparator, a second input of said NOR gate being connected with an output of said first OR gate, a first input of said OR gate being connected to an output of said first AND gate and remaining inputs of said first OR gate being connected with the outputs of first AND gates of switching circuits associated with other elevators of the group, and an output of said first AND gate being connected with a first input of said second OR gate, a second input of second OR gate being connected to said output of said second AND gate and an output of second AND gate being connected with said switching device.

5. The apparatus according to claim 1 wherein, after actuation of said additional key and entry of a call, a first acoustic signal confirming the selection of a car is generated by the call registering and indicating device and a second acoustic signal is generated a short time thereafter but before the arrival of the selected car at the shaft door of the elevator concerned.

6. The apparatus according to claim 1 wherein during the travel of the selected car between the call entry floor and the target floor, a third acoustic signal is generated each time on traveling past a floor and is switched off after the elevator car reaches the target floor.

7. An apparatus for the selection of a elevator car for use by physically handicapped persons from a group of elevators, the elevators of the group having immediate allocation of target calls, including call registering and indicating devices which are located on the floors served by the elevators and including a keyboard for the input of calls for desired target floors a floor call memory which is associated with each elevator of the group and connected with the call registering and indicating devices wherein a call identifying the input floor and a call identifying the target floor are stored in the floor call memory upon actuation of the call registering and indicating device by the input of a call on a floor, a load memory for storing a number of the persons present in the respective elevator car for each floor, a travelling time memory for storing travel times between floors, a computer associated with each of the elevators of the group, a comparison device connected to the computer wherein the computer computes operating costs corresponding to the waiting times of passengers from data specific to the elevator, and an operating costs register connected with the computer, with the comparison device and with an allocation memory connected to the floor call memory, wherein the operating costs for the elevators are compared one with the other by the comparison device and the call concerned is allocated to that elevator which has the smallest operating costs through entry of an allocation instruction into the allocation memory and wherein the elevator concerned and its position are indicated immediately after the call allocation on an indicating field of the actuated call registering and indicating device, comprising:

a switching circuit for an elevator car of an elevator group connected at inputs with a load memory and a second memory portion of a floor call memory which stores calls for target floors;

a first comparator having an output connected to an input of said switching circuit, said first comparator having inputs connected to an output of a travelling time memory and an output of an additional memory, wherein the times needed by physically handicapped persons for travelling the paths between the respectively actuated call registering and indicating devices and the shaft doors of the elevators of the elevator group are stored in said additional memory;

said switching circuit being connected at an output with a switching device connected between an operating costs register and a comparison device wherein, in the absence of an alighting call in the second memory portion and for a load which is smaller than a load limit value as well as for a travelling time of the elevator car which is greater than the time needed by a physically handicapped person to travel from the actuated call registering and indicating device to the shaft door of the elevator concerned, said switching device is actuated by said switching circuit and the elevator car is enabled participate in the operating costs comparison; and an additional key provided on the keyboards of the call registering and indicating devices and connected for activating said switching circuit.

8. An apparatus for the selection of a elevator car for use by physically handicapped persons from a group of elevators, the elevators of the group having immediate allocation of target calls, including call registering and indicating devices which are located on the floors served by the elevators and each including a keyboard for the input of calls for desired target floors, a floor call memory for each elevator car of the group and connected with the call registering and indicating devices wherein a call identifying the input floor and a call identifying the target floor are stored in the floor call memories upon actuation of one of the call registering and indicating devices by the input of a call on a floor, a load memory for each elevator car for storing a number of the persons present in the respective elevator car for each floor, a travelling time memory for each elevator car for storing travel times between floors, a comparison device for each elevator car, and a computer for each elevator car forming the floor call memory, the load memory, the travelling time memory and the comparison device wherein the computer computes operating costs corresponding to the waiting times of passengers from data specific to the elevator, and an operating costs register formed by the computer with an allocation memory connected to the floor call memory, wherein the operating costs for the elevators are compared one with the other by the comparison device and the call concerned is allocated to that elevator which has the smallest operating costs through entry of an allocation instruction into the allocation memory and wherein the elevator concerned and its position are indicated immediately after the call allocation on an indicating field of the actuated call registering and indicating device, comprising:

a switching circuit for each elevator car of an elevator group and for each floor served by the elevator car connected at inputs with a load memory and a second memory portion of a floor call memory which stores calls for target floors;

a first comparator having an output connected to an input of said switching circuit, said first comparator having inputs connected to an output of a travelling time memory and an output of an additional memory, wherein the times needed by physically handicapped persons for travelling the paths between the respectively actuated call registering and indicating devices and the shaft doors of the elevators of the elevator group are stored in said additional memory;

said switching circuit being connected at an output with a switching device connected between an operating costs register and a comparison device wherein, in the absence of an alighting call in the second memory portion and for a load which is smaller than a load limit value as well as for a travelling time of the elevator car which is greater than the time needed by a physically handicapped person to travel from the actuated call registering and indicating device to the shaft door of the elevator concerned, said switching device is actuated by said switching circuit and the elevator car is enabled to participate in the operating costs comparison; and an additional key provided on the keyboards of the call registering and indicating devices and connected for activating said switching circuit associated with a floor.

* * * * *